US010569542B2

(12) United States Patent
Dipert et al.

(10) Patent No.: US 10,569,542 B2
(45) Date of Patent: Feb. 25, 2020

(54) PRINTHEAD PIN CONFIGURATIONS

(71) Applicant: Zebra Technologies Corporation, Lincolnshire, IL (US)

(72) Inventors: Dwight D. Dipert, Barrington, IL (US); Daniel F. Donato, Johnsburg, IL (US)

(73) Assignee: Zebra Technologies Corporation, Lincolnshire, IL (US)

( * ) Notice: Subject to any disclaimer, the term of this patent is extended or adjusted under 35 U.S.C. 154(b) by 0 days.

(21) Appl. No.: 15/238,290

(22) Filed: Aug. 16, 2016

(65) Prior Publication Data

US 2018/0050538 A1 Feb. 22, 2018

(51) Int. Cl.
*B41J 2/14* (2006.01)

(52) U.S. Cl.
CPC .... *B41J 2/1433* (2013.01); *B41J 2002/14491* (2013.01)

(58) Field of Classification Search
CPC ..... B41J 2/14072; B41J 2002/14491; B41J 2/1433; B41J 2/35; B41J 2/355; B41J 2/17546; B41J 2/17526
See application file for complete search history.

(56) References Cited

U.S. PATENT DOCUMENTS 6,137,159 A * 10/2000 Tsubosaki ..... H01L 23/4951 257/666
6,350,013 B1 2/2002 Scheffelin et al.
6,491,377 B1 12/2002 Cleland et al.
9,168,759 B2 10/2015 Hegarty et al.
2002/0097286 A1* 7/2002 Yasuda ..... B41J 2/04541 347/12
2002/0130912 A1* 9/2002 Beck ..... B41J 2/04506 347/12
2005/0157058 A1 7/2005 Silverbrook et al.
2005/0160316 A1* 7/2005 Shipton ..... B41J 2/04505 714/22
2011/0285788 A1 11/2011 Hayasaki et al.
2013/0219093 A1 8/2013 Dipert et al.
2015/0063420 A1* 3/2015 Cho ..... G01K 7/01 374/170

FOREIGN PATENT DOCUMENTS

EP 1031421 A1 8/2000
EP 2098373 9/2009
JP S61102862 5/1986
JP 10006505 A * 1/1998 ..... B41J 2/04518
WO 01/72523 A1 10/2001

OTHER PUBLICATIONS

U.S. Appl. No. 14/670,969, filed Mar. 27, 2015, entitled "High Speed Adaptive Thermal Printhead Interface".
International Search Report and Written Opinion for International Patent Application No. PCT/US2017/036752 dated Aug. 31, 2017.
Search Report and Written Opinion issued by the European Patent Office action in connection with Belgium Patent Application No. BE 2017/5563 dated Jun. 14, 2018.

* cited by examiner

*Primary Examiner* — Sharon A. Polk

(57) ABSTRACT

Printhead pin configurations are disclosed. An example printhead assembly includes an interface to place the printhead assembly in communication with a logic circuit; and a logic circuit configured according to a pin configuration, the pin configuration comprising pin groups, wherein each of the pin groups includes a signal line and a reference voltage.

15 Claims, 11 Drawing Sheets

600

| PIN# | SIGNAL | PIN# | SIGNAL |
|---|---|---|---|
| 1 | STROBE1 | 2 | GND |
| 3 | D1 | 4 | D2 |
| 5 | VDD | 6 | PHCLK1 |
| 7 | GND | 8 | SDA |
| 9 | SCL | 10 | GND |
| 11 | PHCLK2 | 12 | VDD |
| 13 | D3 | 14 | D4 |
| 15 | GND | 16 | B.E.O. |
| 17 | LATCH1 | 18 | GND |
| 19 | D5 | 20 | SPARE |
| 21 | GND | 22 | PHCLK3 |
| 23 | GND | 24 | LATCH2 |
| 25 | D6 | 26 | GND |
| 27 | PHCLK4 | 28 | VDD |
| 29 | D7 | 30 | D8 |
| 31 | GND | 32 | STROBE2 |
| 33 | GND | 34 | D9 |
| 35 | D10 | 36 | VDD |
| 37 | PHCLK5 | 38 | GND |
| 39 | PHTEMP | 40 | PHTEMP RTN |

FIG. 6

800

| PIN# | SIGNAL | PIN# | SIGNAL |
|---|---|---|---|
| 1 | B.E.O. | 2 | SDA |
| 3 | SCL | 4 | VDD |
| 5 | LATCH1 | 6 | STROBE1 |
| 7 | VDD | 8 | DIN1 |
| 9 | DIN2 | 10 | GND |
| 11 | CLOCK1 | 12 | CLOCK2 |
| 13 | GND | 14 | DIN3 |
| 15 | DIN4 | 16 | GND |
| 17 | DIN5 | 18 | DIN6 |
| 19 | GND | 20 | CLOCK3 |
| 21 | CLOCK4 | 22 | GND |
| 23 | DIN7 | 24 | DIN8 |
| 25 | GND | 26 | LATCH2 |
| 27 | STROBE2 | 28 | GND |
| 29 | PHTEMP RTN | 30 | PHTEMP |

FIG. 8

| PIN# | SIGNAL |
|---|---|
| 1 | STROBE1 |
| 2 | GND |
| 3 | D1 |
| 4 | D2 |
| 5 | VDD |
| 6 | PHCLK1 |
| 7 | GND |
| 8 | SDA |
| 9 | SCL |
| 10 | GND |
| 11 | PHCLK2 |
| 12 | VDD |
| 13 | D3 |
| 14 | D4 |
| 15 | GND |
| 16 | BEO |
| 17 | LATCH1 |
| 18 | GND |
| 19 | D5 |
| 20 | UNUSED |
| 21 | GND |
| 22 | PHCLK3 |
| 23 | GND |
| 24 | LATCH2 |
| 25 | D6 |
| 26 | GND |
| 27 | PHCLK4 |
| 28 | VDD |
| 29 | D7 |
| 30 | D8 |
| 31 | GND |
| 32 | STROBE2 |
| 33 | GND |
| 34 | D9 |
| 35 | D10 |
| 36 | VDD |
| 37 | PHCLK5 |
| 38 | GND |
| 39 | PHTEMP |
| 40 | PHTEMP RTN |

1000

FIG. 10

1100

| PIN# | SIGNAL | PIN# | SIGNAL |
|---|---|---|---|
| 1 | B.E.O. | 2 | SDA |
| 3 | SCL | 4 | VDD |
| 5 | LATCH1 | 6 | STROBE1 |
| 7 | VDD | 8 | DIN1 |
| 9 | DIN2 | 10 | GND |
| 11 | CLOCK1 | 12 | CLOCK2 |
| 13 | GND | 14 | DIN3 |
| 15 | DIN4 | 16 | GND |
| 17 | DIN5 | 18 | DIN6 |
| 19 | GND | 20 | CLOCK3 |
| 21 | CLOCK4 | 22 | GND |
| 23 | DIN7 | 24 | DIN8 |
| 25 | GND | 26 | LATCH2 |
| 27 | STROBE2 | 28 | GND |
| 29 | PHTEMP RTN | 30 | PHTEMP |

FIG. 11

PRINTHEAD PIN CONFIGURATIONS

FIELD OF THE DISCLOSURE

This disclosure relates generally to media processing devices and, more particularly, to printhead pin configurations.

BACKGROUND

Some media processing devices include a printhead to generate human and/or machine-readable indicia on media. The printhead receives data and generates the indicia based on the received data. The printhead generates the indicia by, for example, depositing ink on the media, thermally transferring ink to the media, applying energy to particular sections of the media, and/or via any other suitable printing technique.

BRIEF DESCRIPTION OF THE DRAWINGS

FIG. 6 is a table representative of a first example pin configuration constructed in accordance with teachings of this disclosure.

FIG. 8 is a table representative of a second example pin configuration constructed in accordance with teachings of this disclosure.

FIG. 10 is a table representative of a third example pin configuration constructed in accordance with teachings of this disclosure.

FIG. 11 is a table representative of a fourth example pin configuration constructed in accordance with teachings of this disclosure.

DETAILED DESCRIPTION

Figure 1:
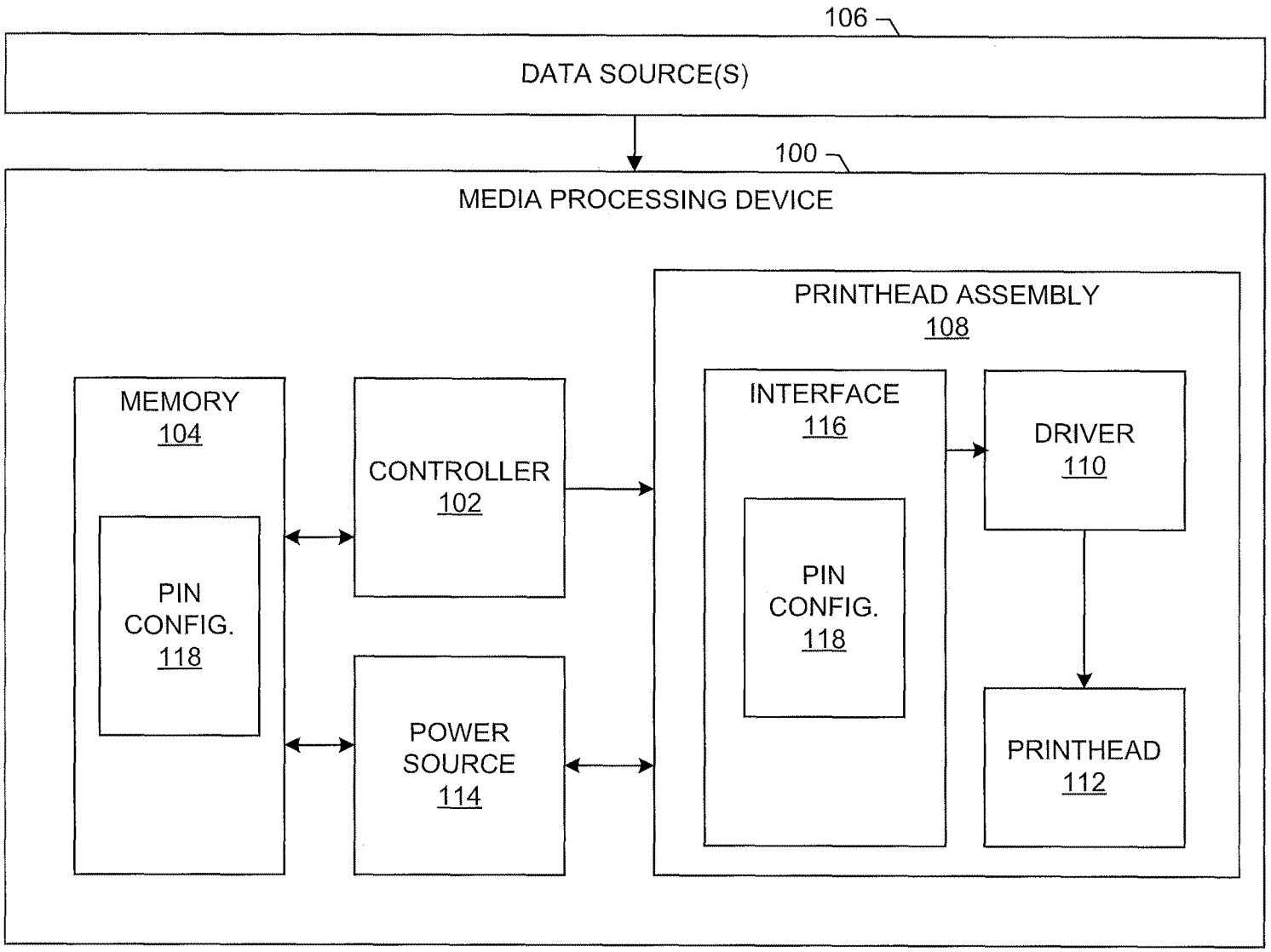
FIG. 1 is a block diagram representative of an example media processing device that may employ teachings of this disclosure.

Some media processing devices, such as printers, are tasked with converting electronic data into indicia on media. The conversion process performed by such media processing devices includes, among other operations, internal communication of the electronic data and interpretation of the electronic data. For example, an example printer includes a controller (e.g., a logic circuit such as a processor or programmable gate array) to receive and/or process (e.g., format) the electronic data, a printhead to generate indicia on media based on the electronic data, cable(s) and/or connector(s) to transmit the electronic data from the controller to the printhead, and interface(s) to facilitate the receipt and/or interpretation of the electronic data at the printhead.

As speed is typically a significant performance metric for such a media processing device, the rates at which communication components of the media processing device transmit, receive, and process the electronic data are key factors. Example pin configurations disclosed herein group pins and, thus, corresponding cables in communication with the pins, in a manner that improves the speed at which the media processing devices convert electronic data into indicia on media. As described in detail below, each pin group of example pin configurations disclosed herein includes at least one signal pin and at least one reference voltage (e.g., ground or any sufficiently coupled reference signal, such as a five (5) volt power connection (VDD)). A pin assigned as a reference voltage is one that is coupled to a constant voltage. Example reference voltages include ground (GND) and a direct current (DC) power connection to, for example, five (5) volts. A pin assigned as a signal pin is one coupled to a source of non-constant or changing values. Example signal pins include pins assigned to a clock line, a data line, a latch line, a strobe line, and a sensor line (e.g., a line coupled to a thermistor).

By including at least one reference voltage, such as ground, in each group of pins (and, thus, cables) through which one or more signals are communicated, an effective loop area between a signal (e.g., a high speed digital data signal) and a return (e.g., ground or other reference voltage) is decreased, thereby reducing propagation times for signals through the circuitry. For example, as described in detail below, example pin configurations disclosed herein provide greater clock rates associated with communication of electronic data over cables (e.g., a 20-inch ribbon cable terminated by insulation-displacement connectors (DC)). Additionally, as described in detail below, example pin configurations disclosed herein provide greater data rates associated with communication of electronic data over cables. As such, example pin configurations disclosed herein enable faster processing of data and, thus, faster conversion of electronic data into indicia on media.

Another key factor for media processing devices is the potentially adverse effects of electromagnetic interference (EMI) caused by the electronic transmissions occurring via, for example, the cable(s) that couple the controller and the printhead. An example adverse effect arising from EMI is "cross-talk" in which electromagnetic radiation from a first wire of a cable directly interferes with a signal being transmitted over a second wire of the same cable and/or another signal being transmitted over wire(s) of a different cable. Additionally or alternatively, susceptibility of circuits and components to ambient electromagnetic radiation may negatively affect functionality of the circuits and/or components. Further, levels of electromagnetic radiation may exceed limits set by, for example, a standard, thereby bringing the corresponding device out of compliance with the standard. While example complications and challenges associated with EMI are described herein, additional or alternative issues may arise due to EMI.

Example pin configurations disclosed herein reduce or eliminate EMI and, thus, improve performance of the otherwise affected components. As described in detail below, example pin configurations disclosed herein enable a physical layout (e.g., spatial relationship) among communication components (e.g., cables and/or) that reduces or eliminates, for example, cross-talk between components. Example pin configurations disclosed herein include pin groups each having at least one signal line and at least one reference voltage (e.g., ground or VDD) to provide a decreased effective loop area, thereby reducing inductance and creating a more consistent impedance for high speed signal lines (e.g., data line and/or clock lines). With the lower inductance provided by examples disclosed herein, interference (e.g., mutual coupling) among signals is reduced. Moreover, as example pin configuration disclosed herein reduce or eliminate EMI, devices that implement examples disclosed herein are better able to comply with, for example, standards that set limits on electromagnetic radiation.

FIG. 1 is a block diagram of an example media processing device 100 in which teachings of this disclosure may be implemented. The example media processing device 100 illustrated in FIG. 1 includes a controller 102 and a driver 110. Alternative implementations of the example media processing device 100 of FIG. 1 include one or more additional or alternative elements, processes and/or devices. Additionally or alternatively, one or more of the example controller 102 and the example driver 110 of FIG. 1 may be combined, divided, re-arranged or omitted. The example controller 102, the example driver 110 and/or, more generally, the example media processing device 100 of FIGS. 1 and/or 2 is/are implemented by hardware, software, firmware, and/or any combination of hardware, software and/or firmware. In some examples, at least one of the example controller 102 and the example driver 110 is implemented by a logic circuit (e.g., the example logic circuit of FIG. 10). As used herein, the term "logic circuit" is expressly defined as a physical device including at least one hardware component configured (e.g., via operation in accordance with a predetermined configuration and/or via execution of stored machine-readable instructions) to control one or more machines and/or perform operations of one or more machines. Examples of a logic circuit include one or more processors, one or more coprocessors, one or more microprocessors, one or more controllers, one or more digital signal processors (DSPs), one or more application specific integrated circuits (ASICs), one or more field programmable gate arrays (FPGAs), one or more microcontroller units (MCUs), one or more hardware accelerators, one or more special-purpose computer chips, and one or more system-on-a-chip (SoC) devices. Some example logic circuits, such as ASICs or FPGAs, are specifically configured hardware for performing operations. Some example logic circuits are hardware that executes machine-readable instructions to perform operations. Some example logic circuits include a combination of specifically configured hardware and hardware that executes machine-readable instructions.

The example media processing device 100 of FIG. 1 includes a controller 102 configured to control certain components of the media processing device 100. In the illustrated example of FIG. 1, the controller 102 is a logic circuit configured to perform print functions. The example controller 102 of FIG. 1 is implemented by any suitable logic circuit such as, for example, one or more processors, microprocessor(s), coprocessor(s) and/or integrated circuit(s) (e.g., an ASIC (application specific integrated circuit), an FPGA (field programmable gate array), etc.). In some examples, the controller 102 is configured to execute instructions stored in memory 104 of the media processing device 100. The example memory 104 of FIG. 1 is implemented by, for example, volatile and/or non-volatile memory that may be either fixed or removable. The example memory 104 of FIG. 1 is configured to store information, data, applications, instructions and/or the like for enabling the controller 102 to, among operations, carry out print functions.

The example controller 102 of FIG. 1 receives data representative of printing tasks (e.g., print jobs) from the memory 104 and/or an external data source 106. Examples of external data sources include a host device, a host system, a network device, and a removable storage device. In the illustrated example of FIG. 1, the controller 102 processes the received data such that the data is usable to print indicia on media. For example, the controller 102 of FIG. 1 utilizes a print engine to generate print data lines (e.g. directly or based on a bit map image) based on the received data.

In the example of FIG. 1, the controller 102 transmits the print data lines (or any other type of data usable to print indicia on media) and control signals (e.g., a latch signal and a strobe signal) to a printhead assembly 108 of the media processing device 100. The example printhead assembly 108 of FIG. 1 includes a driver 110 and a printhead 112. The example driver 110 of FIG. 1 is implemented by a logic circuit configured to control one or more operations of the printhead 112 such that the printhead 112 generates indicia on media in accordance with the received data and control signals. In the example of FIG. 1, the printhead 112 utilizes power from a power source 114 of the media processing device 100 to generate the indicia on the media.

To enable receipt of the electronic data and the control signals by the printhead assembly 108 and to enable handling of the electronic data by the driver 110, the example printhead assembly 108 includes an interface 116. In the illustrated example, the interface 116 is configured to communicate with the controller 102 in accordance with a pin configuration 118. In some examples, data representative of the pin assignments set forth in the pin configuration 118 is stored in the memory 104. In some examples, data representative of the pin assignments set forth in the example pin configuration 118 is additionally or alternatively stored in memory located on the printhead assembly 108. The pin configuration 118 of FIG. 1 defines which pins are dedicated to or assigned to particular types of signals used by the controller 102 to provide data or instructions to the print assembly 108. Example pin configurations disclosed herein that improve the media processing devices are described below in connection with FIGS. 6-9.

Figure 2:
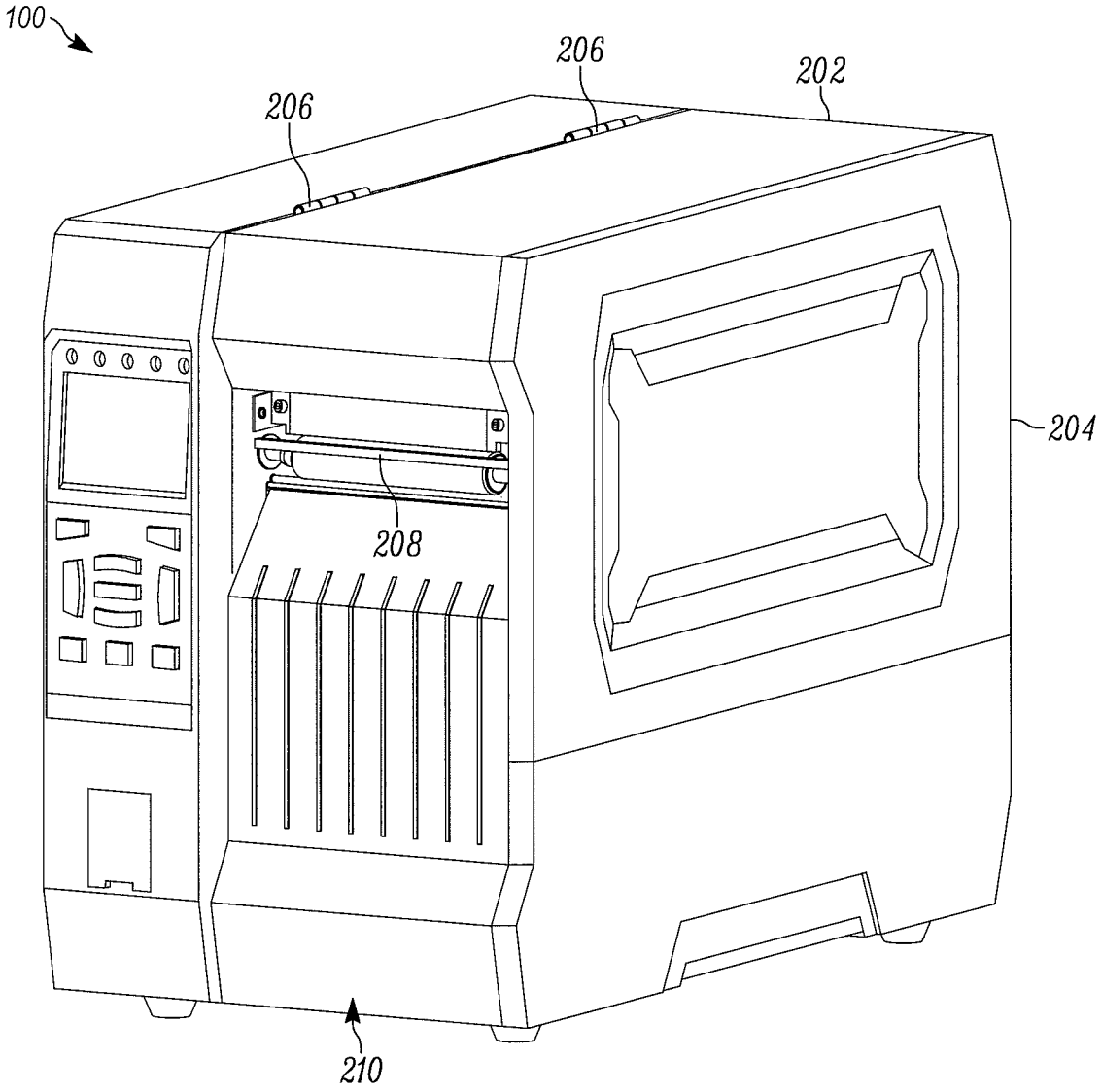
FIG. 2 is a perspective view of an example implementation of the example media processing device of FIG. 1.

FIG. 2 illustrates an example implementation of the media processing device 100 of FIG. 1. The example media processing device 100 of FIG. 2 is a stand-alone unit. However, teachings of this disclosure may be employed in integrated media processing devices such as, for example, an automatic teller machine (ATM), a kiosk, or a point-of-sale device. In the illustrated example of FIG. 2, the media processing device 100 employs thermal printing technology (e.g., direct thermal printing technology, thermal transfer printing technology, and/or dye-sublimation thermal printing technology) to generate indicia on media. For example, the media processing device 100 of FIG. 2 may be a thermal label printer. However, teachings of this disclosure may be employed in connection with any suitable printing technology.

The example media processing device 100 of FIG. 2 includes a housing 202 having a door 104. As depicted in FIG. 2, the door 204 is in a closed, operational position in which access to internal components is precluded. In addition to keeping dirt, dust, and foreign objects from entering an internal cavity of the media processing device 100 and potentially contaminating consumables or electronics, the door 204 may also reduce noise and prevent inadvertent touching of sensitive components. The example door 204 of FIG. 2 is hingedly attached to a frame of the media processing device 100 via hinges 206 such that the door 204 can be opened to provide access to the internal components of the media processing device 100. As described below in connection with FIG. 3, the frame includes a chassis to which some components of the media processing device 100 are mounted. For example, as described below in connection with FIG. 3, a print mechanism mounted to the chassis generates indicia on media fed to the print mechanism by components mounted to the chassis. The print mechanism outputs the media at an exit 208 located along a front face 210 of the housing 202.

Figure 3:
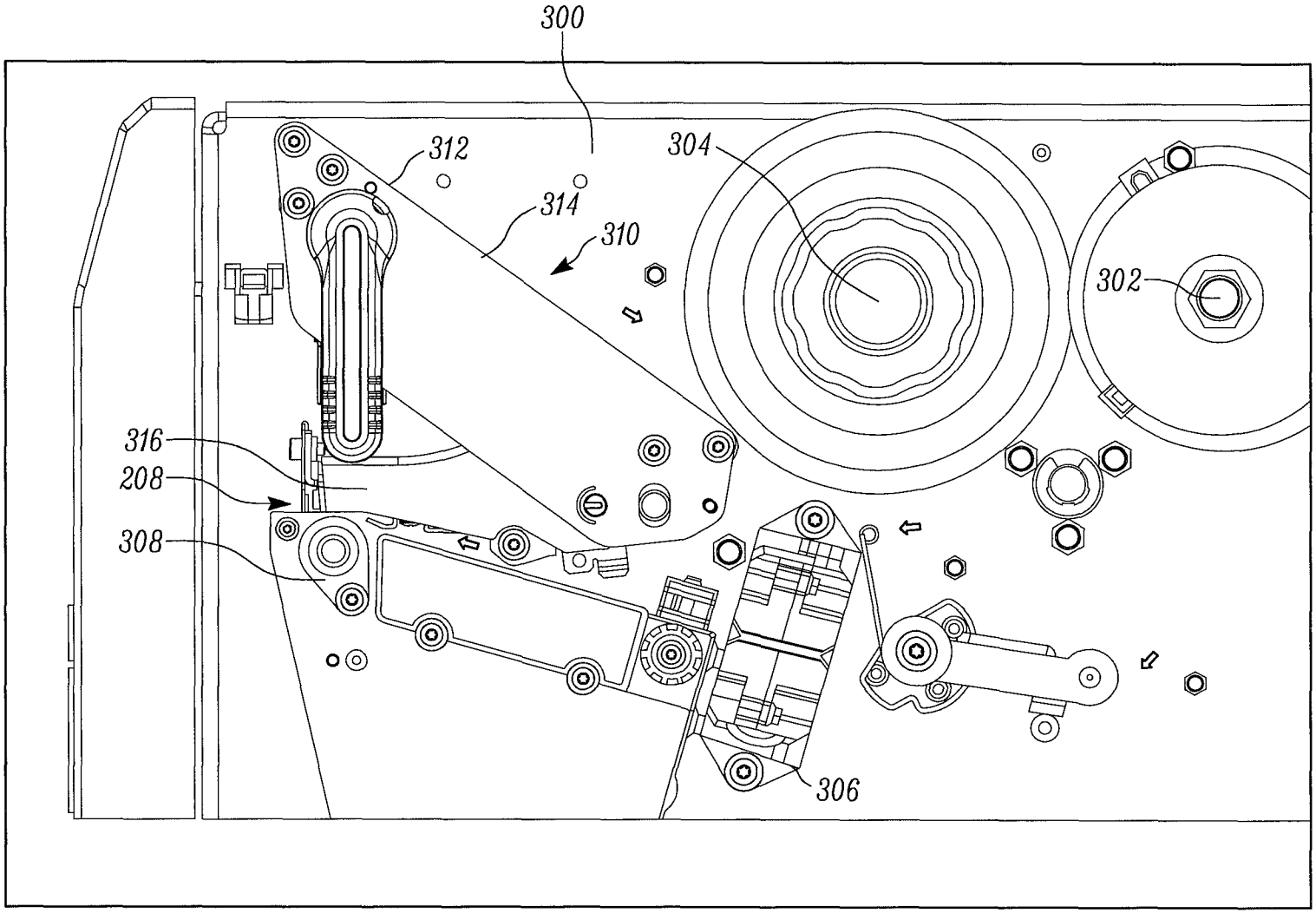
FIG. 3 is a side view of internal components of the example media processing device of FIG. 2.

FIG. 3 depicts a side view of a portion of the example media processing device 100 of FIG. 2 with the door 204 removed. A view similar to that of FIG. 3 is available when the door 204 is opened. As shown in FIG. 3, a chassis 300 supports internal components including a media spindle (not shown), a plurality of guide components (e.g., rollers that guide media and/or ribbon), a ribbon supply spindle 302, a ribbon take-up spindle 304, a transmissive sensor 306, a platen assembly 308, and a print mechanism 310. In the illustrated example of FIG. 3, the print mechanism 310 includes a support structure 312 and removable covers 314 and 316 that shield the print mechanism 310. The media spindle (not shown) is configured to hold a spool of media that is fed to the print mechanism 310 and out the exit 208.

When the media processing device 100 of FIG. 3 is configured for thermal transfer printing, thermal transfer media is mounted to the media spindle and an ink ribbon is mounted to the ribbon supply spindle 302. That is, the ribbon supply spindle 302 is configured to hold a spool of unused ribbon. The ink ribbon is fed from the ribbon supply spindle 302 to the print mechanism 310, which uses the ink ribbon to generate indicia on the media from the media spindle, which is concurrently fed to the print mechanism 310. Used ribbon travels through the print mechanism 310 and is guided to the ribbon take-up spindle 304. That is, the ribbon take-up spindle 304 is configured to hold a spool of used ribbon. The example print mechanism 310 of FIG. 3 generates indicia on the media at a nip formed by a roller of the platen assembly 308 and the printhead 112. In particular, the print mechanism 310, via the driver 110 of FIG. 1, selectively energizes heating elements (e.g., dots) of the printhead 112 to apply heat to the ink ribbon in accordance with, for example, received print line data. At points on the thermal transfer media proximate energized heating elements of the printhead 112, ink is transferred from the ink ribbon to the thermal transfer media, thereby generating indicia on the media representative of the print line data. Depending on the type of media, a threshold number of joules per square inch or Watt*seconds per square inch is needed for the ink of the ribbon to be transferred to the media.

When the media processing device 100 is configured for direct thermal printing, direct thermal media (e.g., labels including heat-sensitive dye(s)) is mounted to the media spindle (not shown). Direct thermal print media (e.g., thermochromic paper) is designed and manufactured such that when a threshold amount of energy is applied to the media, a chemical reaction occurs in the media that causes a change in appearance (e.g., a change in color from white to black). In the example of FIG. 3, the direct thermal media is fed from the media spindle to the print mechanism 310. In such instances, the direct thermal media is not accompanied by an ink ribbon through the print mechanism 310. Instead, in direct thermal mode, the printhead 112 selectively applies heat directly to the direct thermal media fed across the printhead 112, thereby causing a change in appearance of the media at selective locations on the direct thermal media. Depending on the type of media, a threshold number of joules per square inch or Watt*seconds per square inch is needed for a chemical reaction to occur in the direct thermal media to thereby cause a change in appearance of one or more portions of the media.

Figure 4:
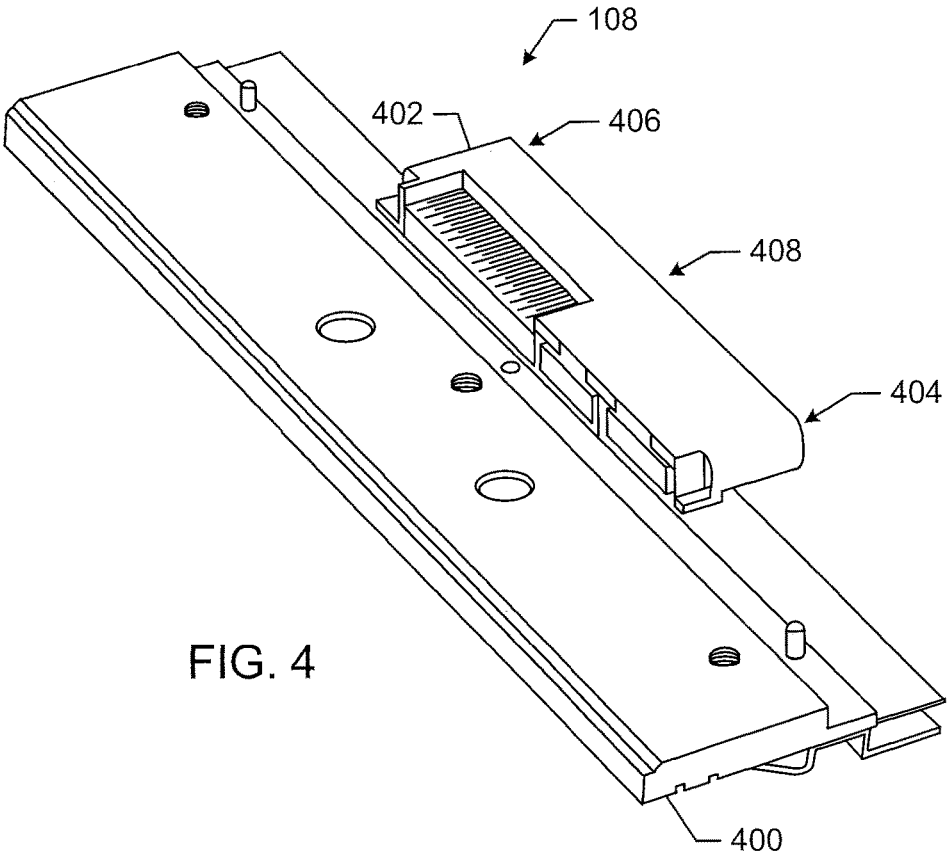
FIG. 4 is a perspective view of an example printhead assembly that may be implemented in the example media processing device of FIG. 2.

FIG. 4 is an example implementation of the printhead assembly 108 of FIG. 1. The example printhead assembly 108 is carried by the example print mechanism 310 of FIG. 3. The example printhead assembly 108 includes the driver 110 (FIG. 1) and a printhead 400. The example printhead 400 has a plurality of heating elements that are referred to as dots. The driver 110 is implemented via a logic circuit configured to control the heating elements of the printhead 400. For example, the driver 110 is implemented as a programmable gate array or by a processor capable of executing machine-readable instructions stored in memory. In accordance with data control signals received from the controller 102 via the interface 116, the driver 110 of the printhead assembly 108 selectively energizes the dots of the printhead 400 to cause a change in appearance of the media fed across the printhead 400. The dots of the example printhead 400 of FIG. 4 are linearly arranged. Based on the content to be printed, different dots for a given line may be turned on or off. For example, if a solid line is to be printed across the media, then all of the dots of the printhead 400 are turned on to print that line as a solid line of dot images. Energizing the printhead dots is referred to as strobing the dots and the time needed to strobe the dots for a particular print event is referred to as the strobe time. Each line of a given print job may be printed by moving the media (e.g., via a motor), relative to the printhead 400 and changing which dots are turned on and which does are turned off. The speed at which the media is printed is often measured in inches per second (ips), which can be related to the line strobe time required from printing individual lines in a print job. A "dot state" refers to whether or not the corresponding dot will be energized. A dot state of "on" or "1" indicates that the corresponding dot is to be energized, while a dot state of "off" or "0" indicates that the corresponding dot should not be energized.

The dots of the printhead 400 are strobed according to control signals received at the printhead assembly 108 from the controller 102 of the media processing device 100. For example, the controller 102 implements a print engine that formats electronic data for delivery to the printhead assembly 108 and to transmit the formatted electronic data to the printhead assembly 108. Put another way, the printhead assembly 108 receives print job information (e.g., print data lines and control signals) and the printhead 400 generates indicia on media based on the received print job information.

Figure 5:
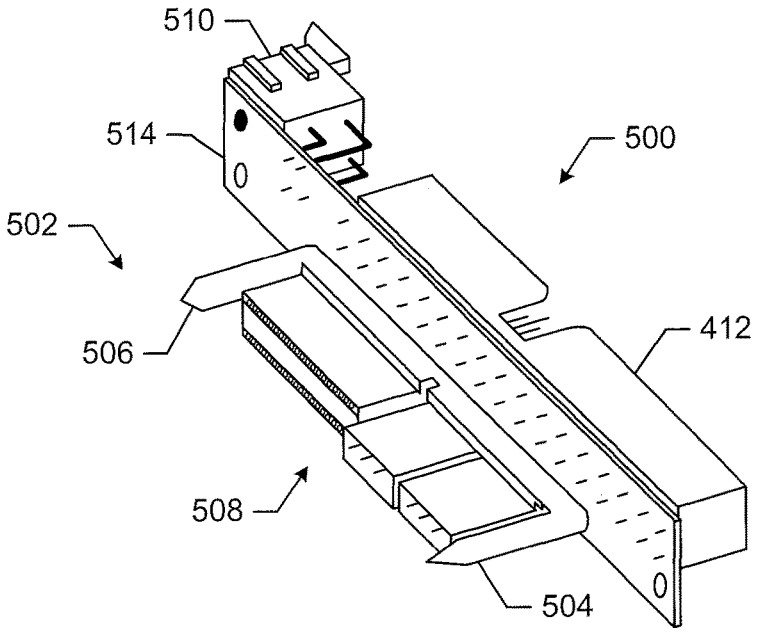
FIG. 5 is a perspective view of an example adapter that may be implemented with the example printhead assembly of FIG. 4.

To receive the print job information, the example printhead assembly 108 of FIG. 4 is removably placed in communication with the controller 102 of the media processing device 100 via the interface 116 (FIG. 1). In the illustrated example, the configuration and structure of the interface 116 depends on the manner in which the printhead assembly 108 is coupled to the controller 102 of the media processing device 100. In some examples, the printhead assembly 108 is placed in communication with the controller 102 via an adapter. FIG. 5 illustrates an example adapter 500 capable of placing the printhead assembly 108 in communication with the controller 102 of the media processing device 100. In such instances, the example adapter 500 of FIG. 5 is mounted to an element (e.g., a printhead carrier) of the print mechanism 310 (FIG. 3). The printhead assembly 108 of FIG. 4 is removably coupled to the example adapter 500 in a single action or movement by matingly engaging or disengaging a female connector 502 of the adapter 500 and a counterpart male connector 402 of the printhead assembly 108. That is, the example printhead assembly 108 of FIG. 4 can be installed in and removed from the media processing device 100 to, for example, replace, clean or inspect the printhead assembly 108. The example female connector 502 of the adapter 500 includes alignment arms 504 and 506 configured to be received at alignment receptacles 404 and 406 of the printhead assembly 108. The alignment arms 504 and 506 of the adapter 500 cooperate with the alignment receptacles 404 and 406 to establish and maintain alignment between the adapter 500 and the printhead assembly 108. The example female connector 502 of the adapter 500 includes a plurality of ports 508 arranged to engage (e.g., mate with) counterpart plugs 408 of the example the male connector 402 of the printhead assembly 108. Accordingly, multiple electrical connections are established simultaneously via the single engagement of the adapter 500 and the printhead assembly 108. Further, multiple electrical connections are severed simultaneously via the single disengagement of the adapter 500 and the printhead assembly 108.

The example adapter 500 FIG. 5 includes a power input connector 510 and a data input connector 512. In some examples, the example adapter 500 includes a different number of power input connectors and/or a different number of data input connectors. The example power input connector 510 of FIG. 5 is coupled to (e.g., via one or more cables or directly to a board) a power source of the example media processing device 100. The example data input connector 512 of FIG. 5 is coupled to (e.g., via one or more cables or directly to a board) a data source such as, for example, the controller 102 of the example media processing device 100 and/or an external data source (e.g., the data source 106 of FIG. 1).

In the illustrated example of FIG. 5, the power input connector 510 and the data input connector 512 are mounted to a board 514. The ports 508 of the female connector 502 are in electrical communication with the power input connector 510 and the data input connector 512 via the board 514. Accordingly, when engaged with the male connector 402 of the printhead assembly 108, the example adapter 500 of FIG. 5 transmits power and data received from the respective sources of the media processing device 100 to the printhead assembly 108. As such, the printhead assembly 108 receives the power required to operate (e.g., selectively energize thermal elements of the printhead 400), the data representative of the indicia to be generated on the media and the control signals used to operate the printhead 400. Example pin configurations disclosed herein that improve the communication and processing of data via these connections are described below in connection with FIGS. 6-9.

While the example connector 502 of the adapter 500 of FIG. 5 is described above as female and the example connector 402 of the printhead assembly 108 of FIG. 3 is described above as male, the connector 502 of the adapter 500 may be configured as a male connector and the connector 402 of the printhead assembly 108 may be configured as a female connector. That is, the electrical connections between the adapter 500 and the printhead assembly 108 are accomplished via any suitable relationship between the connectors. Moreover, the example adapter 500 can employ any suitable additional or alternatives type(s) of connector(s).

In some examples, the printhead assembly 108 is removably placed in communication with the controller 102 of the media processing device 100 without the adapter 500. In such instances, the example connector 402 of FIG. 4 is coupled (e.g., via one or more cables) to the controller 102 of the media processing device 100.

As described above, different manners of placing the printhead assembly 108 in communication with the controller 102 are possible. Examples disclosed herein include pin configurations for particular instances of the printhead assembly 108 communicating with the controller 102. In some examples, the pin configurations disclosed herein are stored on memory of the printhead assembly 108. In some examples, the pin configurations disclosed herein are stored on the memory 104 of the media processing device 100. In the illustrated example, the driver 110 is implemented by a FPGA that is configured according to the pin configuration, which is stored in the memory 104 of the media processing device 100. Additionally, the controller 102 (FIG. 1) is aware of the example pin configuration such that the controller 102 provides data and control signals to the driver 110 in accordance with the configuration of the driver 110. Put another way, the printhead assembly 108 is configured to receive data and control signals from the controller 102 in accordance with a particular pin configuration known to the controller 102.

Figure 7:
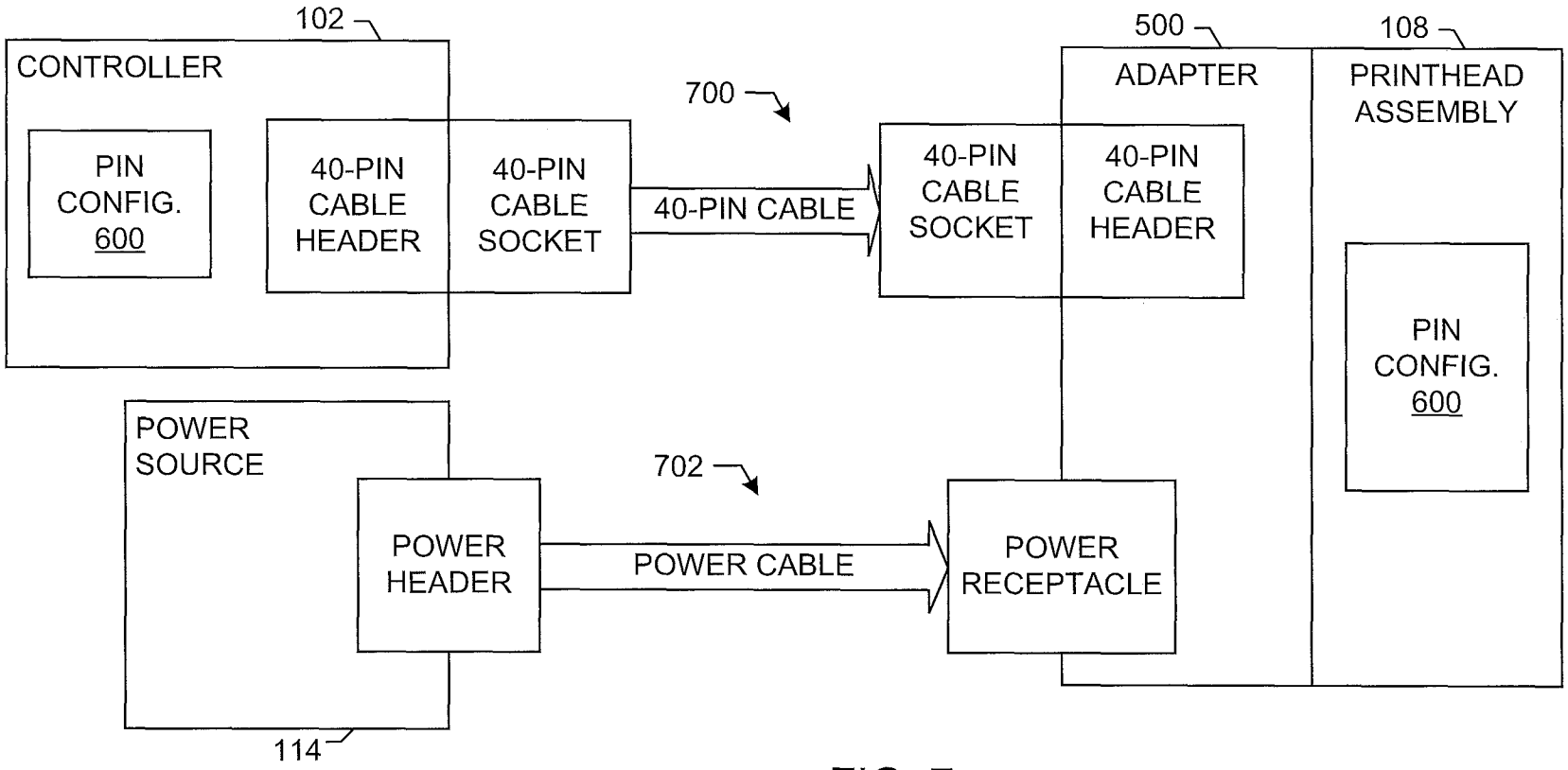
FIG. 7 is a schematic diagram of a first example type of connection between the controller of FIG. 1 and the printhead assembly of FIG. 1.

FIG. 6 is a first example pin configuration 600 for an example communication configuration illustrated in FIG. 7. FIG. 8 is a second example pin configuration 800 for an example communication configuration illustrated in FIG. 9. The following discussion of FIGS. 6-9 refer to the media processing device 100 and other elements of FIGS. 1-5 described above. However, the example pin configurations disclosed herein can be implemented in any suitable device. For example, while FIG. 7 is described below in conjunction with the example adapter 500 of FIG. 5, the example pin configuration disclosed in FIG. 6 can be used in connection with any suitable adapter if such an adapter is implemented in the corresponding media processing device. Additionally, while the example of FIG. 7 discusses particular types of connectors, the example pin configuration disclosed in FIG. 6 can be used in connection with any suitable type of connector.

In the example of FIG. 7, the controller 102 (FIG. 1) is coupled to the adapter 500 (FIG. 5) via a 40-pin connector 700. In the illustrated example of FIG. 7, the 40-pin connector 700 includes a 20-inch ribbon cable and first and second sockets. In the illustrated example of FIG. 7, the first socket of the 40-pin connector 700 is removably coupled to a 40-pin header associated with the controller 102, and the second socket is removably coupled to a 40-pin header of the adapter 500. Additionally, the power source 114 (FIG. 1) is coupled to the adapter 500 via a power connector 702. As described above in connection with FIGS. 4 and 5, the printhead assembly 108 is removably coupled to the adapter 500 such that the printhead assembly 108 receives data, control signals and power via the adapter 500. For example, the data connector of the adapter 500 is coupled with elements of the driver 110 when the printhead assembly 108 is coupled with the adapter 500.

The example pin configuration 600 of FIG. 6 includes designations for each of the forty (40) pins of the example connections illustrated in FIG. 7. The example pin configuration 600 of FIG. 6 includes groups of pins, which are illustrated with shared shading in FIG. 6. In the example of FIG. 6, a first group includes pins 1-7, a second group includes pins 8-13, a third group includes pins 14-20, a fourth group includes pins 21-27, a fifth group includes pins 28-34, and a sixth group includes pins 35-40.

In the example pin configuration 600 of FIG. 6, pin 1 is assigned to a strobe signal line. As described above, the printhead head 112 is strobed when the heating elements are to be energized. Accordingly, a pulse is generated on the strobe signal line when selected ones of the heating elements of the printhead 112 are to be energized. Additionally, pin 32 is assigned to a strobe signal line. As such, the example pin configuration 600 of FIG. 6 includes a first strobe pin assigned to one of the pin groups and a second strobe pin assigned to a different one of the pin groups as the first strobe pin.

In the example pin configuration 600 of FIG. 6, pins 2, 7, 10, 15, 18, 21, 23, 26, 31, 33 and 38 are assigned to a first reference voltage referred to in FIG. 6 as ground (GND). Notably, each of the pin groups in the example pin configuration 600 of FIG. 6 include at least one pin assigned to the first reference voltage. Further, each of four of the pin groups in the example pin configuration 600 of FIG. 6 includes more than one pin assigned to the first reference voltage.

In the example pin configuration 600 of FIG. 6, pin 3 is assigned to a data signal line to receive data representative of print job information. In the illustrated example, the data received via data signal lines is used by the driver 110 of the printhead assembly 108 to determine which heating elements to energize. That is, the data received via data signal lines is representative of the indicia to be generated by the printhead 112. For example, bits are loaded into registers of the driver 110 according to the information received on the data signal lines. In the example pin configuration 600 of FIG. 6, pins 4, 13, 14, 19, 25, 29, 30, 34 and 35 are also assigned to data signal lines. Notably, each of the pin groups in the example pin configuration 600 of FIG. 6 includes at least one data signal pin. The use of multiple (e.g., ten (10)) data signal pins set forth in the example pin configuration 600 of FIG. 6, enables increased throughput (e.g., 250 Mbits/second) to, for example, increase the speed at which data is fed to the registers of the driver 110.

In the example pin configuration 600 of FIG. 6, pin 5 is assigned to a second reference voltage line referred to in FIG. 6 as VDD. In the illustrated example, the VDD lines are 5-volt power connections for use by circuitry of the printhead 112. In the example pin configuration 600 of FIG. 6, pins 12, 28 and 36 are also assigned to VDD lines. While the VDD pins and the GND pins are shown separately in FIG. 6, each of the VDD pins and the GND pins provide a reference voltage and, thus, may be referred to as reference voltages, reference pins, reference signals, or reference pins.

In the example pin configuration 600 of FIG. 6, pin 6 is assigned to a printhead clock signal line. Pins 11, 22, 27 and 37 are also assigned to printhead clock signal lines in the example of FIG. 6. The printhead clock signal lines are utilized by the driver 110 to control operation of the printhead 112. Notably, the example pin configuration 600 of FIG. 6 includes multiple (e.g., five (5)) clock signal lines, which reduces the capacitive loading on each clock signal (e.g., to 75 pF), thereby limiting signal degradation and enabling higher signal frequency (e.g., 25 MHz).

In the example pin configuration 600 of FIG. 6, pin 8 is assigned to a signal line referred to as a serial data line (SDA) line and pin 9 is assigned to a signal line referred to as a serial clock line (SCL). In the illustrated example, the SCL line and the SDA lines are used to communicate with (e.g., via I2C) one or more logic circuits mounted to the printhead 112. For example, the SCL line and the SCL line are used to communicate with an EEPROM mounted to a board of the printhead assembly 108. In some examples, the EEPROM stores information unique to the corresponding printhead 112. In some examples, the SDA line and the SCL line are used to communicate with a security chip of the printhead 112 to, for example, prevent counterfeiting of the printhead 112.

In the example pin configuration 600 of FIG. 6, pin 16 is assigned to a Block Enable Out (B.E.O) signal line, which implements a safety feature that prevents the printhead elements from turning on during power up or power down.

In the example pin configuration 600 of FIG. 6, pin 17 is assigned to a latch signal line. The latch signal controls locking and unlocking of the registers of the driver 110 such that data for one print line is loaded at a time. Notably, the example pin configuration 600 of FIG. 6 includes first and second latch signal pins, namely pin 17, which is assigned to one of the pin groups, and pin 24, which is assigned to a different one of the pin groups as pin 17. The use of multiple latch signal lines in the example pin configuration 600 of FIG. 6 reduces capacitive loading.

In the example pin configuration 600 of FIG. 6, pin 39 is assigned to a printhead temperature signal line. The controller 102 receives data from the temperature signal line and interprets the data to determine one or more temperature measurements of the printhead 112. In some examples, the data provided via the temperature signal line is generated by a sensor (e.g., a thermistor) mounted to the printhead 112. Pin 40 is assigned as a printhead temperature return (PHTEMP RTN), which is a reference voltage to provide a return line for the temperature signal line assigned to pin 39. That is, pin 40 is coupled to a reference voltage.

Notably the grouping of the pins illustrated in the example of FIG. 6, the pin configuration 600 intersperses at least one reference voltage (e.g., GND, PHTEMP RTN, or VDD) with signal lines. In particular, each of the groups in the example pin configuration 600 includes at least one reference voltage and at least one signal line (e.g., PHTEMP, latch, strobe, data, clock, or B.E.O.). Interspersing the reference voltages throughout the pin configuration 600 in this manner enables lower inductance paths needed for higher speed signaling. For example, the pin configuration 600 of FIG. 6 provides increased bandwidth (e.g., 350 MHz) for clock signal lines and data signal lines with reduced loss (e.g., −3 db). Further, the grouping of the pins set forth in the example pin configuration 600 of FIG. 6 enables efficient combing of the cable, thereby improving mechanical routing of the cable. For example, the example pin configuration 600 of FIG. 6 allows the cable to be combed in accordance with the groupings set forth in FIG. 6 such that the cable is combed into six groups, some having seven lines and other having six lines (e.g., 7-6-7-7-7-6). As each group or cable bundle includes at least one reference voltage, the effective loop area between the signal lines and the corresponding returns (e.g., grounds) is decreased. This especially advantageous when the individual cables are combed and separated, in which case, in the absence of the example pin configurations disclosed herein, a single shared reference voltage across different bundles would extend the effective loop area. The decreased loop area provided by the pin configurations disclosed herein reduces inductance and creates a more consistent impedance for, for example, the high speed signal lines (e.g., a digital data line). As such, with the lower inductance, interference (e.g., mutual coupling) among signals is reduced.

In some examples, first pin(s) are purposefully isolated from second pin(s) by assigning the first pin(s) to a first group and the second pin(s) to a second group different than the first group. For example, because a high speed digital signal line, such as PHCLK, will couple energy to a low voltage analog signal line (e.g., PHTEMP), some examples disclosed herein isolate the high speed digital signal line from the low voltage analog signal line by assigning the signals to different groups.

Figure 9:
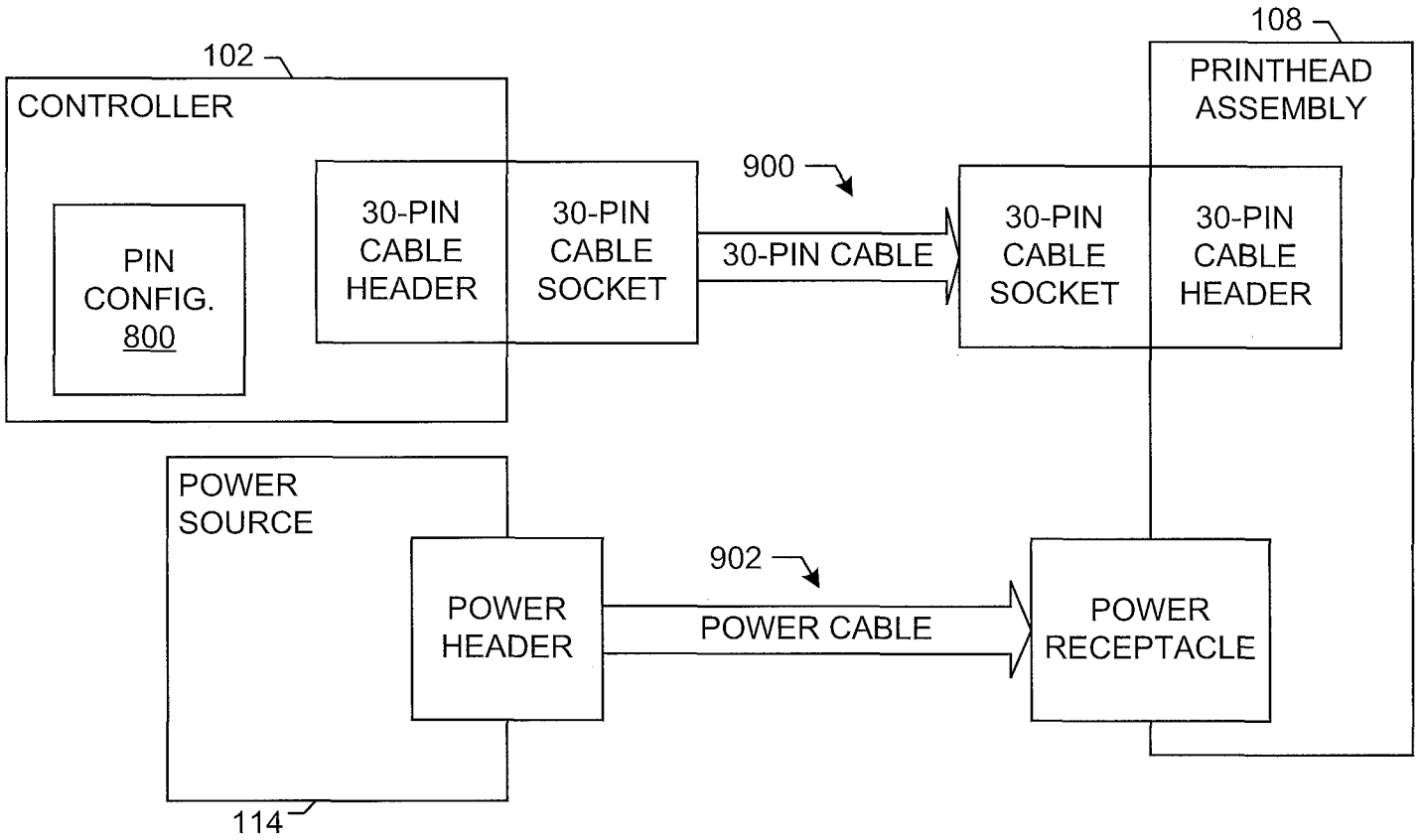
FIG. 9 is a schematic diagram of a second example type of connection between the controller of FIG. 1 and the printhead assembly of FIG. 1.

FIG. 8 is a second example pin configuration 800 for an example communication configuration illustrated in FIG. 9. The example communication configuration of FIG. 9 does not include an adapter between the printhead assembly 108 and the controller 102. Instead, in the example of FIG. 9, the controller 102 (FIG. 1) is coupled to the printhead assembly 108 via a 30-pin connector 900. In the illustrated example of FIG. 9, the 30-pin connector 900 includes a 20-inch ribbon cable and first and second sockets. In the illustrated example of FIG. 9, the first socket of the 30-pin connector 900 is removably coupled to a 30-pin header associated with the controller 102, and the second socket is removably coupled to a 30-pin header of the printhead assembly 108. Additionally, the power source 114 (FIG. 1) is coupled to the printhead assembly 108 via a power connector 902. The printhead assembly 108 is removably coupled to the controller 102 such that the printhead assembly 108 receives data, control signals and power.

The example pin configuration 800 of FIG. 8 includes designations for each of the thirty (30) pins of the example connections illustrated in FIG. 9. The example pin configuration 800 of FIG. 8 includes groups of pins, which are illustrated with shared shading in FIG. 8. In the example of FIG. 8, a first group includes pins 1-8, a second group includes pins 9-14, a third group includes pins 15-20, a fourth group includes pins 21-26 and a fifth group includes pins 27-30.

In the example pin configuration 800 of FIG. 8, pin 1 is assigned to a B.E.O signal line, which prevents the printhead elements from turning on during power up or power down.

In the example pin configuration 800 of FIG. 8, pin 2 is assigned to a SDA signal line and pin 3 is assigned to a SCL signal line.

In the example pin configuration 800 of FIG. 8, pin 4 is assigned to a first reference voltage referred to in FIG. 8 as VDD. In the illustrated example, the VDD lines are 5-volt power connections. In the example pin configuration 800 of FIG. 8, pin 7 is also assigned to the first reference voltage.

In the example pin configuration 800 of FIG. 8, pin 5 is assigned to a latch signal line. The latch signal controls locking and unlocking of the registers of the driver 110 such that data for one print line is loaded at a time. Notably, the example pin configuration 800 of FIG. 8 includes first and second latch signal pins, namely pin 5, which is assigned to one of the pin groups, and pin 26, which is assigned to a different one of the pin groups as pin 5. The use of multiple latch signal pins in the example pin configuration 800 of FIG. 8 reduces capacitive loading.

In the example pin configuration 800 of FIG. 8, pin 6 is assigned to a strobe signal line. As described above, the printhead head 112 is strobed when the heating elements are to be energized. Accordingly, a pulse is generated on the strobe signal line when selected ones of the heating elements of the printhead 112 are to be energized. Additionally, pin 27 is assigned to a strobe signal line. As such, the example pin configuration 800 of FIG. 8 includes a first strobe signal pin assigned to one of the pin groups and a second strobe signal pin assigned to a different one of the pin groups as the first strobe signal pin.

In the example pin configuration 800 of FIG. 8, pin 8 is assigned to a data signal line to receive data representative of print job information. In the illustrated example, the data received via data signal lines is used by the driver 110 of the printhead assembly 108 to determine which heating elements to energize. That is, the data received via data signal lines is representative of the indicia to be generated by the printhead 112. For example, bits are loaded into registers of the driver 110 according to the information received on the data signal lines. In the example pin configuration 800 of FIG. 8, pins 9, 14, 15, 17, 18, 23 and 24 are also assigned to data signal lines. The use of multiple (e.g., eight (8)) data signal lines set forth in the example pin configuration 800 of FIG. 8, enables increased throughput (e.g., 200 Mbits/second) to, for example, increase the speed at which data is fed to the registers of the driver 110.

In the example pin configuration 800 of FIG. 8, pins 10, 13, 16, 19, 22, 25 and 28 are assigned to a second reference voltage referred to in FIG. 8 as GND.

In the example pin configuration 800 of FIG. 8, pin 11 is assigned to a printhead clock signal line. Pins 12, 20 and 21 are also assigned to printhead clock signal lines in the example of FIG. 8. The printhead clock signal lines are utilized by the driver 110 to control operation of the printhead 112. Notably, the example pin configuration 800 of FIG. 8 includes multiple (e.g., four (4)) clock signal lines, which reduces the load on, for example, a clock driver of the example controller 102 of FIG. 7 (e.g., to 60 pF), thereby limiting signal degradation and enabling higher signal frequency (e.g., 25 MHz).

In the example pin configuration 800 of FIG. 8, pin 29 is assigned to a printhead temperature signal line. The controller 102 receives data via the printhead temperature signal line and interprets the data to determine one or more temperature measurements of the printhead 112. In some examples, the data provided via the temperature signal line is generated by a sensor (e.g., a thermistor) mounted to the printhead 112. Pin 30 is assigned as a printhead temperature return (PHTEMP RTN), which is a reference voltage to provide a return line for the temperature signal line assigned to pin 29. That is, pin 30 is coupled to a reference voltage.

By grouping the pins into the example groups shown in FIG. 8, the pin configuration 800 intersperses reference voltages (e.g., ground, PHTEMP RTN, or VDD) with signal lines. In particular, each one of the groups or cable bundles includes at least one reference voltage and at least one signal line. Interspersing the reference voltages among the different groups of pins in this manner enables increased bandwidth (e.g., 350 MHz) for, for example, clock signal lines and data signal lines with reduced loss (e.g., −3 db). Further, the grouping of the pins set forth in the example pin configuration 800 of FIG. 8 enables efficient combing of the cable, thereby improving mechanical routing of the cable. For example, the example pin configuration 800 of FIG. 8 allows the cable to be combed in accordance with the groupings set forth in FIG. 8 such that the cable is combed into six groups, one having eight lines, three having six lines and another having four lines (e.g., 8-6-6-6-4). As each group or cable bundle includes at least one reference voltage, the effective loop area between the signal line(s) and the corresponding return(s) (e.g., ground(s)) is decreased. The decreased loop area reduces inductance and creates a more consistent impedance for the signal lines (e.g., high speed data signal lines). As such, with the lower inductance, interference (e.g., mutual coupling) among signals is reduced.

FIG. 10 is a third example pin configuration 1000 for an example communication configuration illustrated in FIG. 7 which involves the controller 102 (FIG. 1) being coupled to the adapter 500 (FIG. 5) via a 40-pin connector 700. The example pin configuration 1000 of FIG. 10 includes designations for each of the forty (40) pins of the example connections illustrated in FIG. 7. The example pin configuration 1000 of FIG. 10 includes groups of pins, which are illustrated with shared shading in FIG. 10. In the example of FIG. 10, a first group includes pins 1-3, a second group includes pins 4-7, a third group includes pins 8-12, a fourth group includes pins 13-16, a fifth group includes pins 17-20, a sixth group includes pins 21-24, a seventh group includes pins 25-27, an eighth group includes pins 28-31, a ninth group includes pins 32-34, a tenth group includes pins 35-38, and an eleventh group includes pins 39 and 40.

The assignments of the pins (e.g., which pins are assigned to data signal lines, which pins are assigned to clock signal lines, which pins are assigned to reference voltages, etc.) in FIG. 10 are the same as the pin assignments of FIG. 6. However, the example pin configuration 1000 of FIG. 10 includes different groupings of the pins than the example pin configurations 600 of FIG. 6. As in the example pin configuration 600 of FIG. 6, the example pin configuration 1000 intersperses reference voltages (e.g., GND or VDD) with signal lines (e.g., latch signal lines, clock signal lines, strobe signals, etc.). In particular, each group of the example pin configuration 1000 includes at least one reference voltage and at least one signal line, thereby lowering inductance paths needed for higher speed signaling and reducing EMI.

FIG. 11 is a fourth example pin configuration 1100 for an example communication configuration illustrated in FIG. 9 which involves the controller 102 (FIG. 1) being coupled to the printhead assembly 108 via the 30-pin connector 900. The example pin configuration 1100 of FIG. 11 includes designations for each of the thirty (30) pins of the example connections illustrated in FIG. 9. The example pin configuration 1100 of FIG. 11 includes groups of pins, which are illustrated with shared shading in FIG. 11. In the example of FIG. 11, a first group includes pins 1-4, a second group includes pins 5-8, a third group includes pins 9-11, a fourth group includes pins 12-14, a fifth group includes pins 15-17, a sixth group includes pins 18-20, a seventh group includes pins 21-23, an eighth group includes pins 24-26, a ninth group includes pins 27-28, and a tenth group includes pins 29-30.

The assignment of the pins in FIG. 11 is the same as the pin assignments of FIG. 8. However, the example pin configuration 1100 of FIG. 11 includes different groupings of the pins than the example pin configurations 800 of FIG. 8. As in the example pin configuration 800 of FIG. 8, the example pin configuration 1100 of FIG. 11 intersperses reference voltages with signal lines. In particular, each of the groups of the example pin configuration 1000 includes at least one reference voltage and at least one signal line, thereby lowering inductance paths needed for higher speed signaling and reducing EMI.

Figure 12:
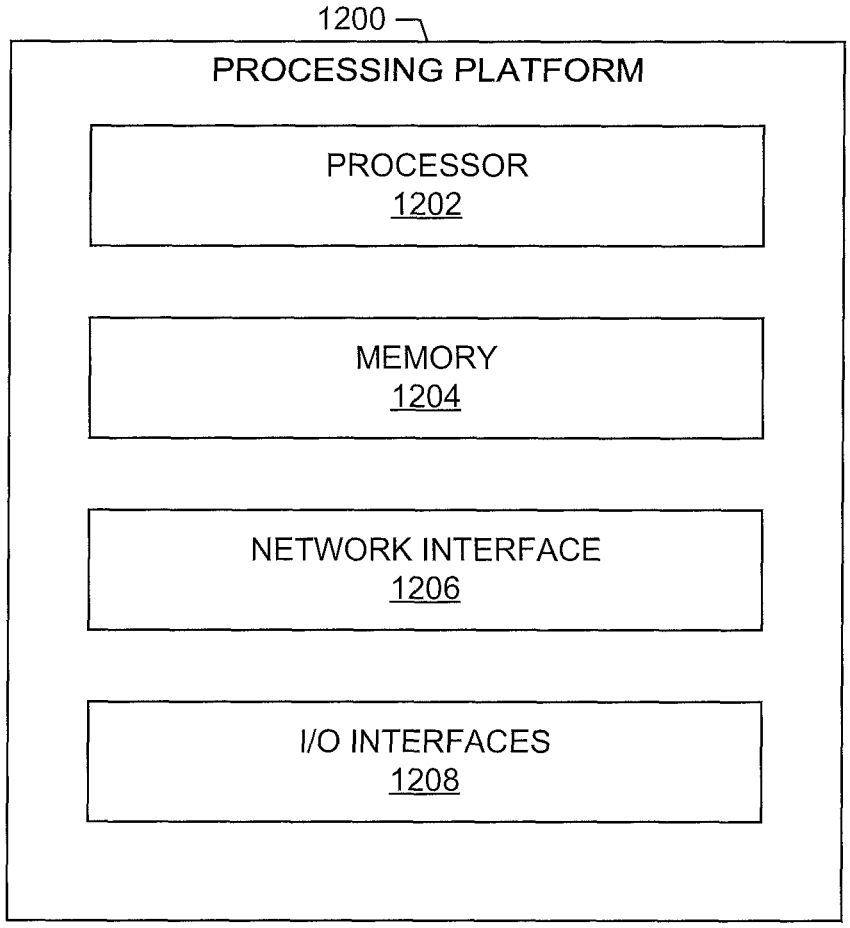
FIG. 12 is a block diagram of an example logic circuit for implementing the example controller of FIG. 1, the example interface of FIG. 1, the example driver of FIG. 1 and/or any other logic circuit associated with teachings of this disclosure

FIG. 12 is a block diagram representative of an example logic circuit that may utilized to implement, for example, the controller 102 of FIG. 1 and/or the driver 110 of FIG. 1. The example logic circuit of FIG. 12 is a processing platform 1200 capable of executing instructions to, for example, implement printing operations of the media processing device 120 of FIG. 1.

The example processing platform 1200 of FIG. 12 includes a processor 1202 such as, for example, one or more microprocessors, controllers, and/or any suitable type of processor. The example processing platform 1200 of FIG. 12 includes memory (e.g., volatile memory, non-volatile memory) accessible by the processor 1202 (e.g., via a memory controller). The example processor 1202 interacts with the memory 1204 to obtain, for example, machine-readable instructions stored in the memory 1204 corresponding to, for example, printing operations the example media processing device 100 of FIG. 1. Additionally or alternatively, machine-readable instructions may be stored on one or more removable media (e.g., a compact disc, a digital versatile disc, removable flash memory, etc.) that may be coupled to the processing platform 1200 to provide access to the machine-readable instructions stored thereon.

The example processing platform 1200 of FIG. 12 includes a network interface 1206 to enable communication with other machines via, for example, one or more networks. The example network interface 1206 includes any suitable type of communication interface(s) (e.g., wired and/or wireless interfaces) configured to operate in accordance with any suitable protocol(s).

The example processing platform 1200 of FIG. 12 includes input/output (I/O) interfaces 808 to enable receipt of user input and communication of output data to the user.

As used herein, each of the terms "tangible machine-readable medium," "non-transitory machine-readable medium" and "machine-readable storage device" is expressly defined as a storage medium (e.g., a platter of a hard disk drive, a digital versatile disc, a compact disc, flash memory, read-only memory, random-access memory, etc.) on which machine-readable instructions (e.g., program code in the form of, for example, software and/or firmware) can be stored. Further, as used herein, each of the terms "tangible machine-readable medium," "non-transitory machine-readable medium" and "machine-readable storage device" is expressly defined to exclude propagating signals. That is, as used in any claim of this patent, a "tangible machine-readable medium" cannot be read to be implemented by a propagating signal. Further, as used in any claim of this patent, a "non-transitory machine-readable medium" cannot be read to be implemented by a propagating signal. Further, as used in any claim of this patent, a "machine-readable storage device" cannot be read to be implemented by a propagating signal.

As used herein, each of the terms "tangible machine-readable medium," "non-transitory machine-readable medium" and "machine-readable storage device" is expressly defined as a storage medium on which machine-readable instructions are stored for any suitable duration of time (e.g., permanently, for an extended period of time (e.g., while a program associated with the machine-readable instructions is executing), and/or a short period of time (e.g., while the machine-readable instructions are cached and/or during a buffering process)).

Although certain example apparatus, methods, and articles of manufacture have been disclosed herein, the scope of coverage of this patent is not limited thereto. On the contrary, this patent covers all apparatus, methods, and articles of manufacture fairly falling within the scope of the claims of this patent.

What is claimed is:

1. A printhead assembly, comprising:

an interface to place the printhead assembly in communication with a controller of a printer; and a logic circuit configured to control heating elements according to control signals provided by the controller via the interface, the interface being configured according to a pin configuration, the pin configuration comprising pin groups, wherein the pin groups are defined based on which pins of the pin configuration are to be bundled together, in multiple corresponding bundles, where the multiple corresponding bundles are packaged in a corresponding cable bundle, each of the pin groups includes a signal line pin and a reference voltage pin, the signal line pin is coupled to a source of changing values, and the reference voltage pin is coupled to a constant voltage.

2. A printhead assembly as defined in claim 1, wherein the pin configuration has forty pins and eleven pin groups.

3. A printhead assembly as defined in claim 1, wherein the pin configuration includes ten data pins.

4. A printhead assembly as defined in claim 1, wherein the pin configuration includes five clock pins.

5. A printhead assembly as defined in claim 1, wherein the pin configuration includes first and second latch pins.

6. A printhead assembly as defined in claim 5, wherein the first latch pin is assigned to a first one of the pin groups and the second latch pin is assigned to a second one of the pin groups.

7. A printhead assembly as defined in claim 1, wherein the pin configuration includes first and second strobe pins.

8. A printhead assembly as defined in claim 7, wherein the first strobe pin is assigned to a first one of the pin groups and the second strobe pin is assigned to a second one of the pin groups.

9. A printhead assembly as defined in claim 1, wherein the pin configuration includes thirty pins and ten pin groups.

10. A printhead assembly as defined in claim 1, wherein the reference voltage pin is assigned a first reference voltage, and each of a plurality of the pin groups includes a second reference voltage pin assigned a second reference voltage different than the first reference voltage.

11. A printhead assembly as defined in claim 1, wherein the logic circuit implements a driver for a printhead including heating elements.

12. A printhead assembly as defined in claim 1, wherein the pin configuration includes multiple clock pins.

13. A printhead assembly, comprising:

an interface to place the printhead assembly in communication with a controller of a printer; and a logic circuit configured to control heating elements according to control signals provided by the controller via the interface, the interface being configured according to a pin configuration, the pin configuration comprising pin groups, wherein the pin groups are defined based on which pins of the pin configuration are to be bundled together, in multiple corresponding bundles, where the multiple corresponding bundles are packaged in a corresponding cable bundle, each of the pin groups includes a signal line pin and a reference voltage pin, and the pin configuration includes first and second strobe pins.

14. A printhead assembly, comprising:

an interface to place the printhead assembly in communication with a controller of a printer; and a logic circuit configured to control heating elements according to control signals provided by the controller via the interface, the interface being configured according to a pin configuration, the pin configuration comprising pin groups, wherein the pin groups are defined based on which pins of the pin configuration are to be bundled together in a corresponding cable bundle, each of the pin groups includes a signal line pin and a reference voltage pin, and the pin configuration includes thirty pins and ten pin groups.

15. A printhead assembly, comprising:

an interface to place the printhead assembly in communication with a controller of a printer; and a logic circuit configured to control heating elements according to control signals provided by the controller via the interface, the interface being configured according to a pin configuration, the pin configuration comprising pin groups, wherein the pin groups are defined based on which pins of the pin configuration are to be bundled together, in multiple corresponding bundles, where the multiple corresponding bundles are packaged in a corresponding cable bundle, and each of the pin groups includes a signal line pin and a reference voltage pin.

* * * * *